US006502537B2

(12) United States Patent
Todo et al.

(10) Patent No.: US 6,502,537 B2
(45) Date of Patent: Jan. 7, 2003

(54) VALVE TIMING CONTROL DEVICE OF INTERNAL COMBUSTION ENGINE

(75) Inventors: Tamotsu Todo, Kanagawa (JP); Masahiko Watanabe, Yokohama (JP)

(73) Assignee: Unisia JECS Corporation, Atsugi (JP)

( * ) Notice: Subject to any disclaimer, the term of this patent is extended or adjusted under 35 U.S.C. 154(b) by 0 days.

(21) Appl. No.: 10/042,257

(22) Filed: Jan. 11, 2002

(65) Prior Publication Data

US 2002/0100444 A1 Aug. 1, 2002

(30) Foreign Application Priority Data

Jan. 31, 2001 (JP) ..... 2001-024077

(51) Int. Cl.[7] ..... F01L 1/34
(52) U.S. Cl. ..... 123/90.17
(58) Field of Search ..... 123/90.15, 90.17, 123/90.31

(56) References Cited

U.S. PATENT DOCUMENTS 5,219,313 A * 6/1993 Danieli ..... 464/2
5,234,088 A * 8/1993 Hampton ..... 192/44
5,803,030 A * 9/1998 Cole ..... 123/90.17
6,213,071 B1 * 4/2001 Lancefield et al. ..... 123/90.17
6,250,267 B1 * 6/2001 Methley ..... 123/90.17
6,328,008 B1 * 12/2001 Io ..... 123/90.17

FOREIGN PATENT DOCUMENTS

JP 10-153104 6/1998

* cited by examiner

*Primary Examiner*—Weilun Lo
(74) *Attorney, Agent, or Firm*—Foley & Lardner

(57) ABSTRACT

A relative rotation angle control mechanism of a valve timing control device comprises a radial guide provided by one of drive and driven rotation members which are rotatable about a given axis. A movable control member is guided by the radial guide in a manner to move in a radial direction with respect to the given axis. A link links the movable control member to a given portion of the other of the drive and driven members. The given portion is positioned away from the given axis in a radial direction. An intermediate rotation member is rotatable about the given axis relative to both the drive and driven rotation members. A spiral guide is provided by the intermediate rotation member to guide the movement of the movable control member, so that rotation of the intermediate rotation member relative to the radial guide induces a radial movement of the movable control member. A sliding resistance reducing structure is further arranged between the movable control member and the intermediate rotation member to reduce a sliding resistance produced when the movable control member is moved.

25 Claims, 10 Drawing Sheets

VALVE TIMING CONTROL DEVICE OF INTERNAL COMBUSTION ENGINE

BACKGROUND OF THE INVENTION

1. Field of the Invention

The present invention relates in general to a control device for controlling operation of an internal combustion engine, and more particularly to a valve timing control device which controls or varies an open/close timing of intake and/or exhaust valves of the internal combustion engine in accordance with an operation condition of the engine.

2. Description of the Related Art

In order to clarify the task of the present invention, one valve timing control device of an internal combustion engine will be briefly described, which is shown in Laid-open Japanese Patent Application (Tokkai-hei) 10-153104.

In the valve timing control device of the publication, a timing pulley driven by a crankshaft of the engine is rotatably disposed around a shaft member which is integrally connected to a camshaft. A so-called "relative rotation angle control mechanism" is arranged between the timing pulley and the shaft member. The relative rotation angle control mechanism comprises generally a piston member which is axially movably connected to the timing pulley while being suppressed from rotating about an axis thereof relative to the timing pulley, a first helical gear which is formed on a cylindrical inner surface of the piston member, a second helical gear which is formed on a cylindrical outer surface of the shaft member and meshed with the first helical gear and an electric actuator which moves the piston member axially. The electric actuator comprises an electromagnet and a return spring. That is, by moving the piston member forward or rearward to a desired position by the electric actuator, a relative rotation angle between the timing pulley and the shaft member is controlled or varied.

However, due to the nature of the mutually meshed two helical gears, a considerable meshing resistance is inevitably produced by them, which tends to deteriorate a smoothed angle change of the shaft member relative to the timing pulley. If, for reducing the meshing resistance, the two helical gears are so arranged that mutually meshed teeth of the two helical gears have a certain gap kept therebetween, noises would be produced due to variable torque of the camshaft. Furthermore, if, for reducing the meshing resistance, the inclination angle of the helical teeth of each gear is increased, the size of these helical gears would become increased, which brings about a bulky construction of the relative rotation angle control mechanism.

SUMMARY OF THE INVENTION

It is therefore an object of the present invention to provide a valve timing control device of an internal combustion engine, which is free of the above-mentioned drawbacks.

That is, according to the present invention, there is provided a valve timing control device of an internal combustion engine, which is compact in size and assures a smoothed rotation angle change of the shaft member relative to the timing pulley without producing uncomfortable noises.

According to a first aspect of the present invention, there is provided a valve timing control device of an internal combustion engine, which comprises a drive rotation member rotated about a given axis by a crankshaft of the engine; a driven rotation member rotated about the given axis together with a camshaft of the engine; a relative rotation angle control mechanism through which the drive and driven rotation members are coaxially connected, the relative rotation angle control mechanism having a movable control member which, when actuated, varies a relative rotation angle between the drive and driven rotation members in accordance with an operation condition of the engine, the relative rotation angle control mechanism comprising a radial guide provided by one of the drive and driven rotation members; the movable control member guided by the radial guide in a manner to move in a radial direction with respect to the given axis; a link which links the movable control member to a given portion of the other of the drive and driven members, the given portion being positioned away from the given axis in a radial direction; an intermediate rotation member rotatable about the given axis relative to both the drive and driven rotation members; a spiral guide provided by the intermediate rotation member to guide the movement of the movable control member, so that rotation of the intermediate rotation member relative to the radial guide induces a radial movement of the movable control member; and a sliding resistance reducing structure arranged between the movable control member and the intermediate rotation member to reduce a sliding resistance produced when the movable control member is moved.

According to a second aspect of the present invention, there is provided a valve timing control device of an internal combustion engine, which comprises a drive rotation member rotated about a given axis by a crankshaft of the engine; a driven rotation member rotated about the given axis together with a camshaft of the engine; a radial guide provided by one of the drive and driven members; a movable control member guided by the radial guide in a manner to move in a radial direction with respect to the given axis; a link liking the movable control member to a given portion of the other of the drive and driven members, the given portion being positioned away from the given axis in a radial direction; an intermediate rotation member rotatable about the given axis relative to both the drive and driven rotation members; a spiral guide groove provided on one surface of the intermediate rotation member; a semi-spherical recess formed in the movable control member, the recess facing the one surface of the intermediate rotation member; and a rolling ball rotatably and slidably engaged with both the spiral guide groove and the semi-spherical recess.

According to a third aspect of the present invention, there is provided a valve timing control device of an internal combustion engine, which comprises a drive rotation member rotated about a given axis by a crankshaft of the engine; a driven rotation member rotated about the given axis together with a camshaft of the engine; a radial guide provided by one of the drive and driven members; a movable control member guided by the radial guide in a manner to move in a radial direction with respect to the given axis; a link liking the movable control member to a given portion of the other of the drive and driven members, the given portion being positioned away from the given axis in a radial direction; an intermediate rotation member rotatable about the given axis relative to both the drive and driven rotation members; a spiral guide groove provided on one surface of the intermediate rotation member, the spiral guide groove having a semi-circular cross section; a semi-spherical recess formed in the movable control member, the recess facing the one surface of the intermediate rotation member; and a rolling ball rotatably and slidably engaged with both the spiral guide groove and the semi-spherical recess, at least one of the spiral guide groove and the semi-spherical recess having a radius of curvature that is greater than that of the rolling ball.

According to a fourth aspect of the present invention, there is provided a valve timing control device of an internal combustion engine, which comprises a drive rotation member rotated about a given axis by a crankshaft of the engine; a driven rotation member rotated about the given axis together with a camshaft of the engine; a radial guide provided by one of the drive and driven members; a movable control member guided by the radial guide in a manner to move in a radial direction with respect to the given axis; a link liking the movable control member to a given portion of the other of the drive and driven members, the given portion being positioned away from the given axis in a radial direction; an intermediate rotation member rotatable about the given axis relative to both the drive and driven rotation members; a spiral guide groove provided on one surface of the intermediate rotation member; a semi-spherical recess formed in the movable control member, the recess facing the one surface of the intermediate rotation member; a rolling ball rotatably and slidably engaged with both the spiral guide groove and the semi-spherical recess; and a biasing structure which biases at least one of the intermediate rotation member and the movable control member toward the rolling ball.

Other objects and features of the present invention will become apparent from the following description when taken in conjunction with the accompanying drawings.

DETAILED DESCRIPTION OF THE EMBODIMENTS

In the following, various embodiments of the present invention will be described in detail with reference to the accompanying drawings.

For ease of understanding, the following description will contain various directional terms, such as, left, right, upper, lower and the like. However, such terms are to be understood with respect to only a drawing or drawings on which the corresponding part or element is illustrated.

Referring to FIGS. 1 to 6 of the drawings, there is shown a valve timing control device 100 which is a first embodiment of the present invention.

Although the valve timing control device 100 is described as being applied to intake valves of an internal combustion engine, the device 100 can be also applied to exhaust valves of the engine.

Figure 1:
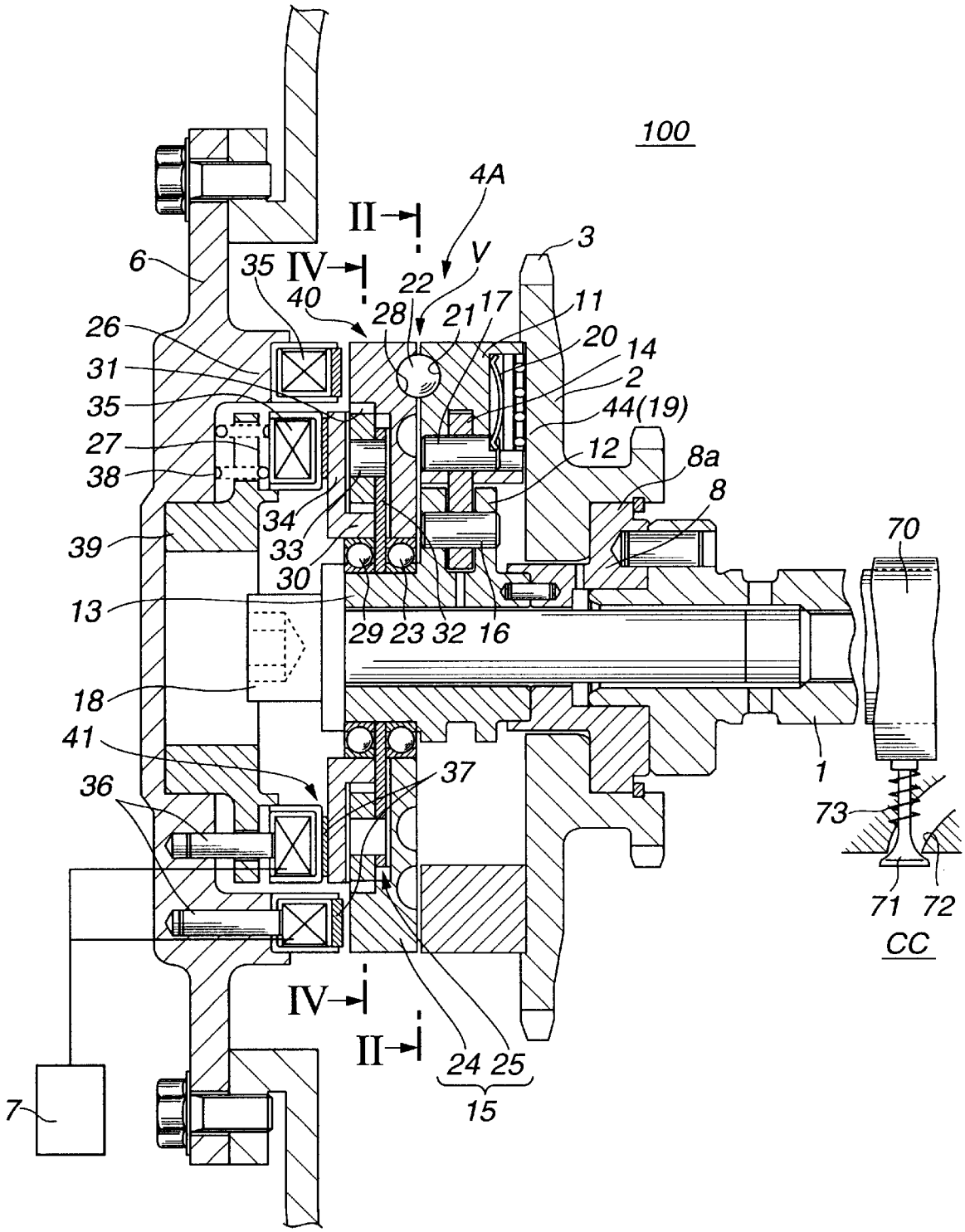
FIG. 1 is a sectional view of a valve timing control device which is a first embodiment of the present invention.

As is understood from FIG. 1, the valve timing control device 100 is arranged on a cylinder head which has a plurality of intake ports 72 (only one is shown) and a plurality of exhaust ports (not shown) which extend from combustion chambers "CC" in a known manner. Each intake port 72 has an intake valve 71 which functions to open and close the intake port 72. Due to function of a valve spring 73, each intake valve 71 is biased in a direction to close the intake port 72. The intake valves 71 are driven by respective cams 70 provided on a camshaft 1 which is supported on the cylinder head in a manner to rotate about its axis.

Rotatably disposed around a front (viz., left) end portion of the camshaft 1 is a circular drive plate 2. The drive plate 2 is formed at its periphery with teeth 3 (viz., timing sprocket) and is driven or rotated by a crankshaft (not shown) of the engine.

At a front (viz., left) side of the camshaft 1 and the drive plate 2, there are arranged a relative rotation angle control mechanism 4A which varies a relative rotation angle between the camshaft 1 and the drive plate 2, an operating mechanism 15 which operates the relative rotation angle control mechanism 4A and a VTC cover 6 which is arranged to straddle front ends of the cylinder head and a rocker cover (not shown) in a manner to cover or conceal the drive plate 2, the relative rotation angle control mechanism 4A and the operating mechanism 15. Denoted by numeral 7 is a controller which controls the operating mechanism 15 in accordance with an operating condition of the engine.

To the front end of the camshaft 1, there is secured an annular spacer 8 which is formed with a stopper flange 8*a*. The drive plate 2 is rotatably disposed on the spacer 8 while being suppressed from making an axial movement by the stopper flange 8*a*.

The camshaft 1 and the spacer 8 constitute a driven rotation body and the drive plate 2 constitutes a drive rotation body.

Figure 2:
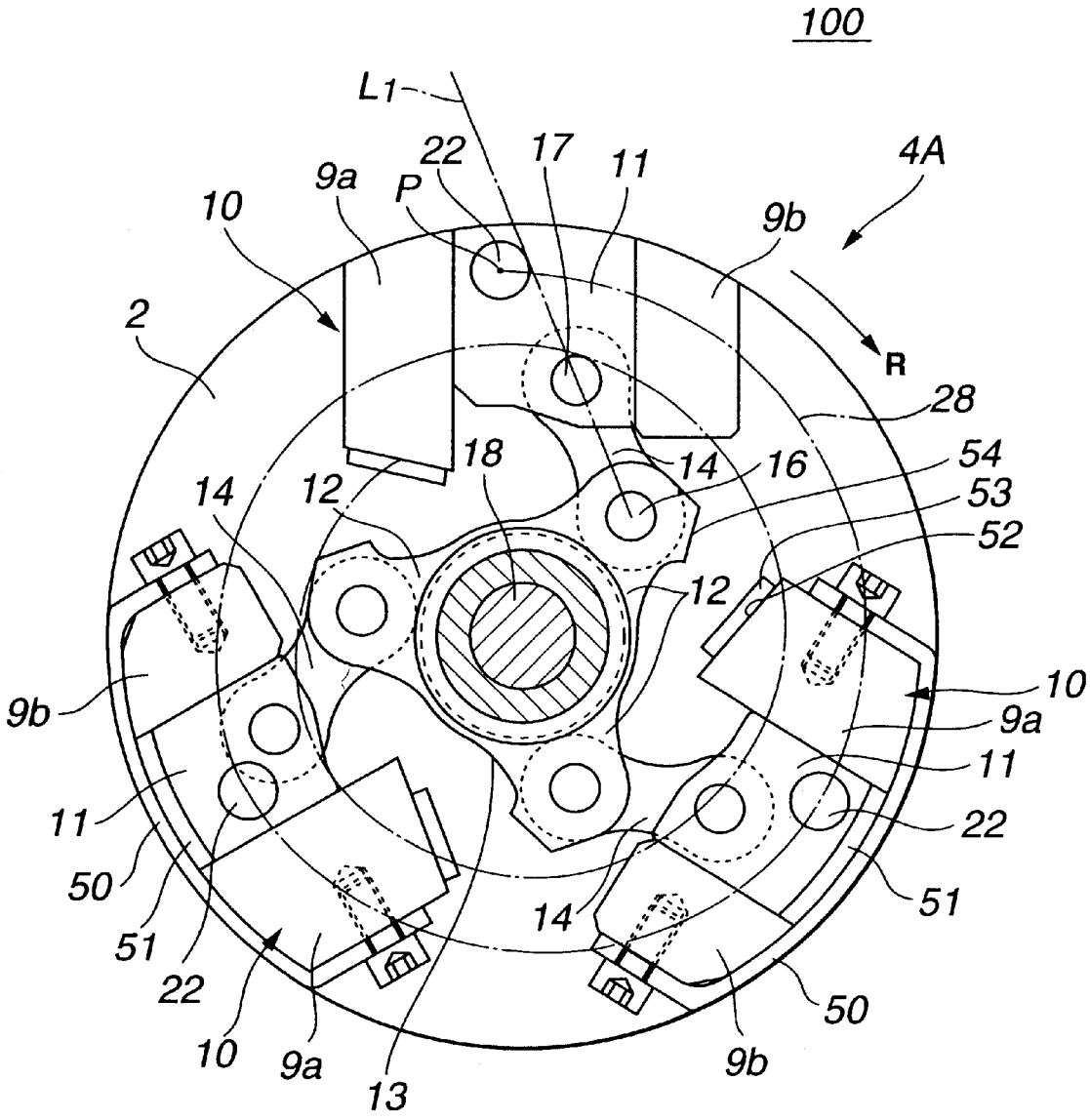
FIG. 2 is a sectional view taken along the line "II—II" of FIG. 1 showing the most-retarded angular position of a camshaft relative to a drive plate.

As is seen from FIG. 2, on the front surface of the drive plate 2, there are provided three radial guide units 10 which are arranged around an axis of the drive plate 2 at equally spaced intervals, each including a pair of parallel guide walls 9*a* and 9*b*. As shown, the paired guide walls 9*a* and 9*b* of each radial guide unit 10 extend generally radially. As will be described in detail hereinafter, between the paired guide walls 9*a* and 9*b* of each radial guide unit 10, there is radially slidably disposed a sliding member 11 of the relative rotation angle control mechanism 4A.

It is now to be noted that the radial guide unit 10 is not limited to such a unit having parallel guide walls 9*a* and 9*b* that extend exactly in a radial direction. That is, the radial guide unit 10 may be constructed to guide the sliding member 11 in a generally radial direction.

As is seen from FIGS. 1 and 2, the relative rotation angle control mechanism 4A is incorporated with a lever shaft 13 which is coaxially connected to the left end (as viewed in FIG. 1) of the camshaft 1 together with the spacer 8 by means of a bolt 18.

As is seen from FIG. 2, the lever shaft 13 is integrally formed with three radial levers 12 which are arranged at evenly spaced intervals.

The relative rotation angle control mechanism 4A has three sliding members 11, each being radially slidably disposed between the above-mentioned paired guide walls 9*a* and 9*b* of the corresponding radial guide unit 10. The sliding members 11 are each shaped generally rectangular. The three radial levers 12 of the lever shaft 13 are pivotally and respectively connected to the three sliding members 11 by means of three link arms 14. That is, each of the link arms 14 has an inner end pivotally connected to the corresponding lever 12 through a pivot pin 16 and an outer end pivotally connected to the corresponding sliding member 11 through a pivot pin 17.

As is described hereinabove and as is easily understood from FIGS. 1 and 2, each of the sliding members 11 is radially movably guided by the corresponding radial guide unit 10, and is connected to the camshaft 1 through the link arm 14 and the lever 12 of the lever shaft 13. Thus, when, upon receiving an external force, the sliding members 11 are moved radially outward or inward along the respective guide units 10, the link mechanism including the sliding members 11, the link arms 14 and the levers 12 brings about a relative rotation between the drive plate 2 and the camshaft 1 by an angle corresponding to the radial displacement of the sliding members 11.

It is now to be noted that if each sliding member 11 is constructed swingable in the guide unit 10, the sliding member 11 and the corresponding link arm 14 may be integrally formed into a single part. More specifically, in this modification, each sliding member 11 is cylindrical in shape and rotatably slidable in the guide way defined between the parallel guide walls 9*a* and 9*b* of the guide unit 10.

As is seen from FIG. 1, each sliding member 11 is equipped at a rear side thereof with a radially movable roller unit 44 which is biased toward the drive plate 2 by a plate spring 20. More specifically, as is seen from FIG. 6 which shows the detail of the sliding member 11 and its associated parts, but in an opposite direction, the sliding member 11 is formed at the rear end thereof with a rectangular recess 43 into which the roller unit 44 and the plate spring 20 are operatively received together with a retainer 45 of the roller unit 44. The roller unit 44 has a plurality of rollers 19 installed therein.

Figure 5:
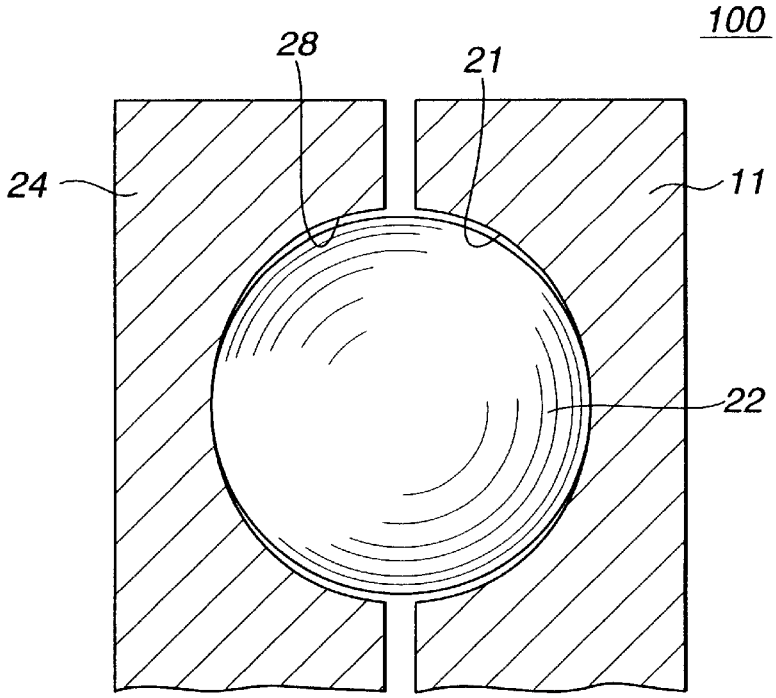
FIG. 5 is an enlarged sectional view of a portion indicated by the arrow "V" in FIG. 1.
Figure 6:
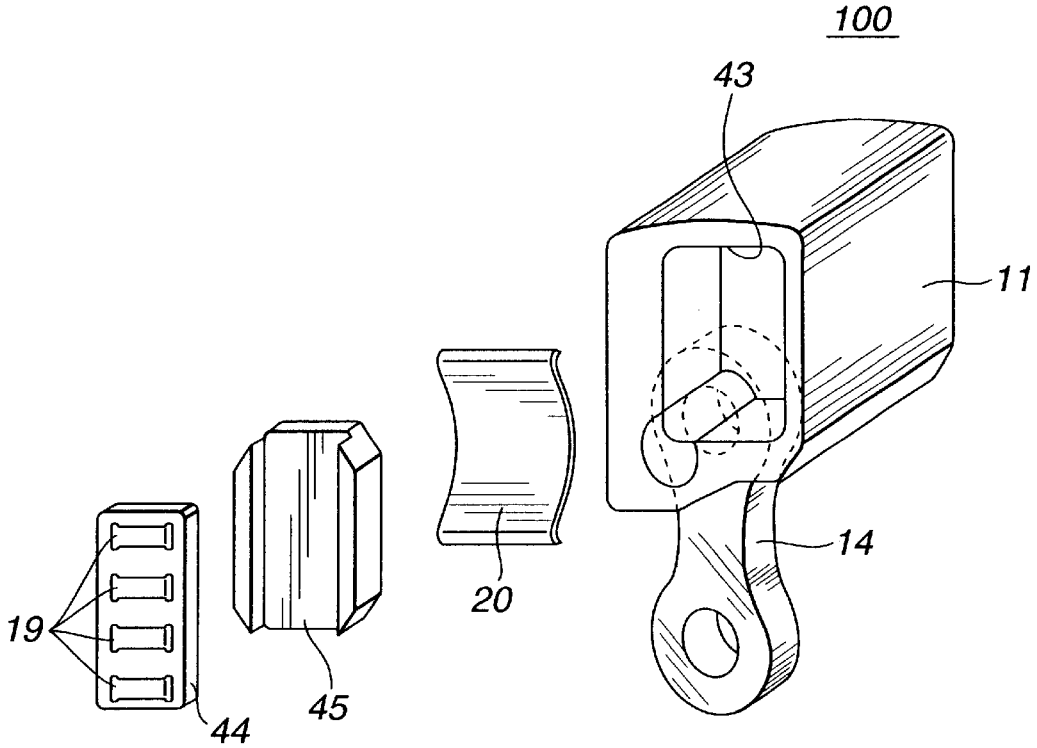
FIG. 6 is a schematic exploded view of a unit including a sliding member and a link member, which is employed in the valve timing control device of the first embodiment.

As is easily seen from FIGS. 1, 2 and 5, each sliding member 11 is formed on a front surface thereof with a semi-spherical recess 21 in which a half part of a rolling ball 22 is received. Due to provision of the above-mentioned spring plate 20, the sliding member 11 is biased toward the rolling ball 22, as will be seen from FIG. 1.

As is understood from FIG. 1, a circular guide plate 24 is rotatably disposed on a front (or left) end portion of the lever shaft 13 through a bearing 23.

A conversion mechanism 40 is employed which, when the guide plate 24 and the drive plate 2 make a relative rotation therebetween, moves the sliding members 11 radially outward or inward by a degree corresponding to the relative rotation.

A guide plate actuating mechanism 41 is further employed, which forces the guide plate 24 to take a desired rotation angle relative to the guide units 10, that is, relative to the drive plate 2.

The conversion mechanism 40 comprises the three rolling balls 22 held by the sliding members 11, and the guide plate 24. As is seen from FIGS. 1 and 2, the guide plate 24 is formed on its rear surface with a concentric spiral guide groove 28 in which the rolling balls 22 are slidably and rotatably received. The spiral guide groove 28 has a semi-circular cross section.

As is seen from FIG. 2, the spiral guide groove 28 is shaped so as to gradually reduce its radius as it advances in the direction of the arrow "R". Accordingly, when, with the rolling balls 22 kept received in the spiral guide groove 28, the guide plate 24 makes a rotation in a speed reducing direction relative to the drive plate 2, each siding member 11 is moved radially inward along the guide walls 9*a* and 9*b* of the guide unit 10 while sliding in and along the spiral guide groove 28. While, when the guide plate 24 makes a rotation in a speed increasing direction relative to the drive plate 2, the sliding member 11 is moved radially outward along the guide walls 9*a* and 9*b* while sliding in and along the spiral guide groove 28.

As is well shown in FIG. 5, the radius of curvature of the spiral guide groove 28 and that of the semi-spherical recess 21 are larger than that of the rolling balls 22. More specifically, at least one of the spiral guide groove 28 and the semi-spherical recess 21 has a radius of curvature that is larger than that of the rolling ball 22. This assures a smoothed movement and operation of the rolling balls 22 even when the guide groove 28 and the recess 21 have been subjected to a certain manufacturing error. If desired, only one of the spiral guide groove 28 and semi-spherical recess 21 may have such relation.

Figure 4:
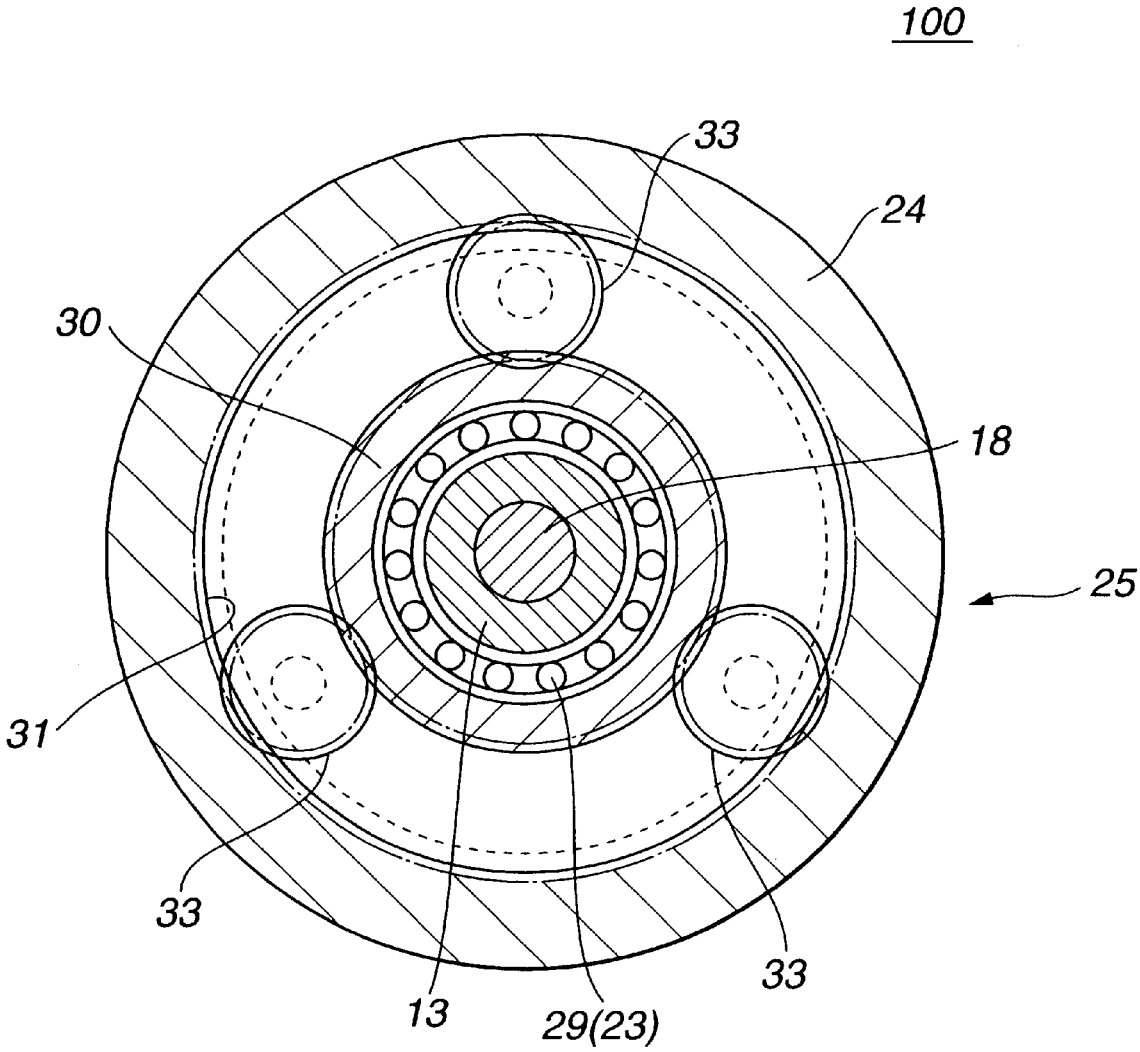
FIG. 4 is a sectional view taken along the line "IV—IV" of FIG. 1.

As is seen from FIGS. 1 and 4, the guide plate actuating mechanism 41 has a planetary gear unit 25 and first and second electromagnetic brakes 26 and 27.

The planetary gear unit 25 comprises a sun gear 30 which is rotatably disposed on a front end of the lever shaft 13 through a bearing 29, a ring gear 31 which is formed on an inner surface of a cylindrical recess formed in a front side of the guide plate 24, a carrier plate 32 which is secured to the lever shaft 13 at a position between the bearings 23 and 29, and three pinion gears 33 which are rotatably supported by the carrier plate 32 and meshed with both the sun gear 30 and ring gear 31.

Thus, when, with the sun gear 30 kept free, the pinion gears 33 are turned around an axis of the lever shaft 13 together with the carrier plate 32 without rotation, the sun gear 30 and the ring gear 31 are rotated about the axis at the same speed. And, when, under this condition, a braking force is applied to only the sun gear 30, the sun gear 30 is forced to make a rotation in a speed reducing direction relative to the carrier plate 32 causing rotation of each pinion gear 33 resulting in that the ring gear 31 is accelerated turning the guide plate 24 in a speed increasing direction relative to the drive plate 2.

Referring back to FIG. 1, the first and second electromagnetic brakes 26 and 27 of the guide plate actuating mechanism 41 are annular in shape. As shown, the second brake 27 is concentrically arranged in the first brake 26. The first and second brakes 26 and 27 have substantially the same construction. The first brake 26 is arranged to face a peripheral part of the front surface of the guide plate 24, and the second brake 27 is arranged to face an annular brake flange 34 integral with the sun gear 30. As shown, the annular brake flange 34 extends radially outward from the front end of the sun gear 30 in a manner to conceal the planetary gears 33.

Each of the first and second electromagnetic brakes 26 and 27 comprises an annular magnetic force generating core 35 which is loosely held by pins 36 secured to a rear side of the VTC cover 6 and an annular friction pad 37 which is attached to a rear side of the core 35. The magnetic force generating core 35 comprises an annular coil and an annular yoke which are coupled. When, in the first brake 26, the magnetic force generating core 35 is energized, the friction pad 37 is forced to contact the guide plate 24 to brake the same. As shown, in only the second brake 27, a spring 38 is employed for biasing the magnetic force generating core 35 toward the brake flange 34. Thus, in the second brake 27, the friction pad 37 is kept in contact with the brake flange 34 when the magnetic force generating core 35 is not energized. That is, when, in the second brake 27, the core 35 is energized, the friction pad 37 is released from the brake flange 34. Thus, when an associated internal combustion engine is at a standstill and/or an electric system fails to operate, a certain braking force is applied to the sun gear 30 by the second brake 27 through the brake flange 34.

An axial movement of the magnetic force generating core 35 of the second brake 27 is guided by a retainer ring 39 which is secured to a rear surface of the VTC cover 6. The retainer ring 39 is constructed of magnetic material, and thus the ring 39 can provide a path for magnaflux produced when the core 35 of the second brake 27 is energized.

From the drive plate 2 to the camshaft 1, there is transmitted a drive force or torque through the sliding members 11, the link arms 14 and the levers 12 of the lever shaft 13. While, from the camshaft 1 to the sliding members 11, there is inputted the variable torque (or alternating torque) of the camshaft 1 through the levers 12 of the lever shaft 13 and the link arms 14. The variable torque is caused by a counterforce of each intake valve 71 (viz., a counterforce caused by the force of each valve spring 73).

More specifically, as is seen from FIG. 2, the variable torque applied to each sliding member 11 is a force (or vector) having a direction which passes through both one pivot point between the lever 12 and the link arm 14 and the other pivot point between the sliding member 11 and the link arm 14.

As is described hereinabove, each sliding member 11 is guided by the corresponding radial guide unit 10 in a manner to move radially, and due to provision of the rolling ball 22 having a half part received in the semi-spherical recess 21 of the sliding member 11 and the other half part received in the spiral guide groove 28 of the guide plate 24, the force inputted to each sliding member 11 from the leading end of the corresponding lever 12 through the corresponding link arm 14 is substantially received or supported by both the guide walls 9*a* and 9*b* of the guide unit 10 and the spiral guide groove 28 of the guide plate 24.

As may be understood from FIG. 2, the guide walls 9*a* and 9*b* of each guide unit 10 are inclined in a direction in which the spiral guide groove 28 converges with respect to a radial direction of the drive plate 2, and the guide walls 9*a* and 9*b* intersect the spiral guide groove 28 at generally right angles.

Accordingly, the force inputted to each sliding member 11 from the corresponding link arm 14 is divided into two components which intersect at right angles, and these two components are received by the walls of the spiral guide groove 28 and the guide walls 9*a* and 9*b* at generally right angles. Under this condition, movement of each sliding member 11 is assuredly suppressed. Accordingly, once the sliding members 11 have been moved to predetermined radial positions by the braking force produced by the first and second electromagnetic brakes 26 and 27, the sliding members 11 can keep their positions even if the braking force is released from them. That is, once the sliding members 11 have come to the predetermined positions changing the phase of rotation of the camshaft 1, the changed phase of rotation of the camshaft 1 can be maintained thereafter.

Figure 3:
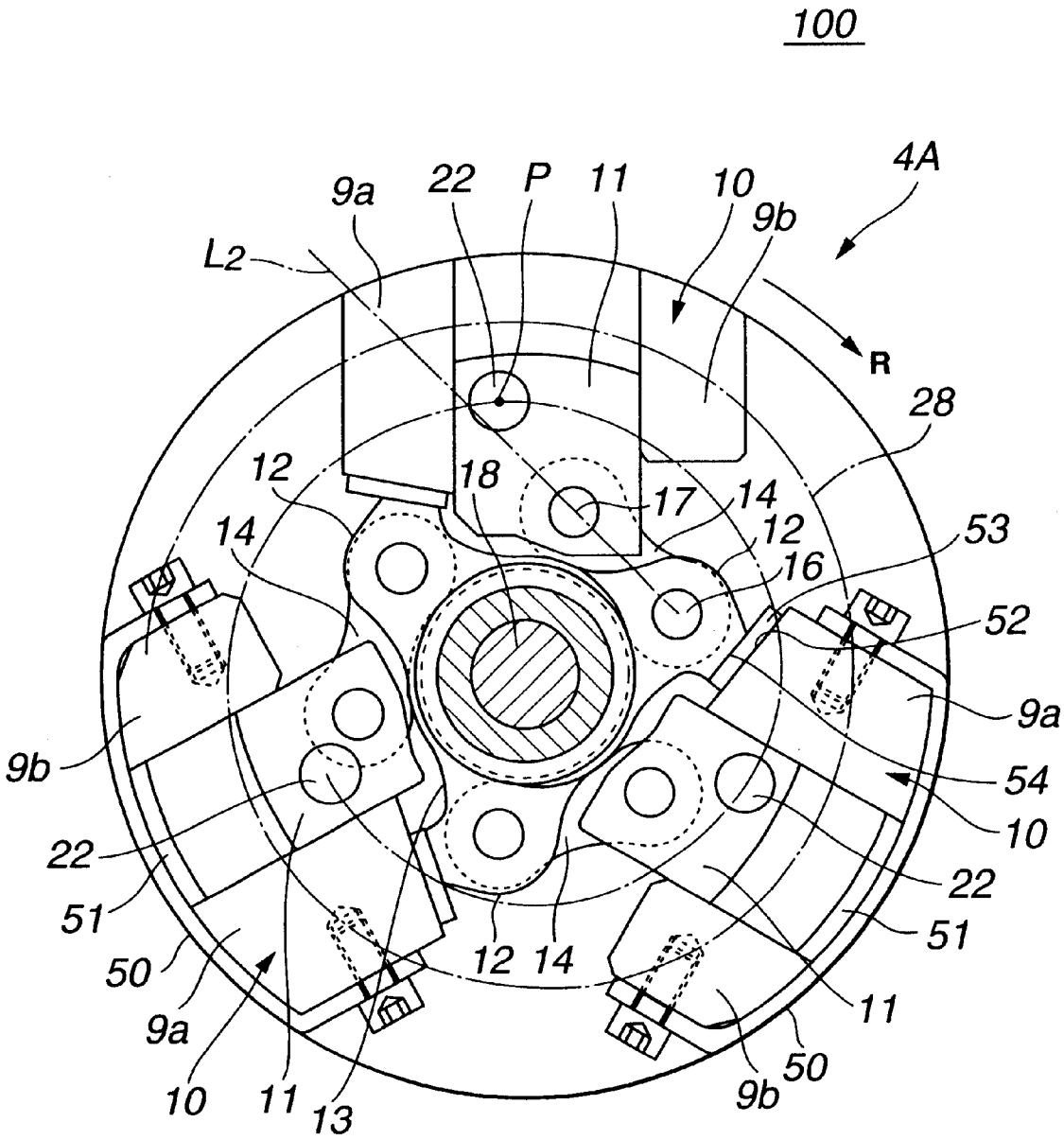
FIG. 3 is a view similar to FIG. 2, but showing the most-advanced angular position of the camshaft.

As is seen from FIGS. 2 and 3, preferably, the rolling ball 22 of each sliding member 11 and the corresponding link arm 14 have such a positional relation that a center "P" of the rolling ball 22 is constantly placed in a range between a line of action "$L_1$" of the link arm 14 appearing when a most-retarded control is established and a line of action "$L_2$" of the link arm 14 appearing when a most-advanced control is established. This reason is as follows. That is, an inclination angle of the line of action "$L_1$" or "$L_2$" of the link arm 14 (viz., the inclination angle established when the position of the pivot pin 16 is made constant) varies in accordance with the radial movement of the sliding member 11. However, if the center "P" of the rolling ball 22 is set to be placed between the lines of action "$L_1$" and "$L_2$" as is described hereinabove, the distance between the center "P" of the rolling ball 22 and the line of action "$L_1$" or "$L_2$" is not so increased even if the most-retarded or most-advanced control is carried out. Accordingly, the force applied to the sliding member 11 along the line of action of the link arm 14 does not provide the center "P" of the rolling ball 22 with a marked moment, and thus, undesirable inclination of the sliding member 11 caused by such a larger moment is avoided. That is, the resistance against the sliding movement of each sliding member 11 is further reduced.

In the drawings (particularly, FIGS. 2 and 3), denoted by numeral 50 are stoppers for stopping excessive outer radial movement of the sliding members 11, and denoted by numeral 51 are shock absorbers attached to the stoppers 50 for absorbing the shock produced when the sliding members 11 run against the stoppers 50. Denoted by numeral 54 are stopping edges of the lever shaft 13 which, when the lever shaft 13 is rotated to its one terminal end relative to the drive plate 2, are brought into contact with leading edges 52 of the guide walls 9*a* thereby to suppress excessive rotation of the lever shaft 13 relative to the drive plate 2, and denoted by numeral 53 are shock absorbers attached to the leading edges 52 for absorbing a shock produced when the stopping edges 54 run against the leading edges 52.

As is seen from FIG. 2, when each sliding member 11 is moved to the radially outermost position, the rolling ball 22 held by one of the three sliding members 11 is located in the outermost end of the spiral guide groove 28 of the guide plate 24. While, as is seen from FIG. 3, when each sliding member 11 is moved to the radially innermost position, the rolling ball 22 held by the other one of the three sliding members 11 is located in the innermost end of the spiral guide groove 28. Thus, if the outer and inner end portions of the spiral guide groove 28 are each shaped to have a gradually reducing depth, a so-called wedge effect is produced between each sliding member 11 and the guide plate 24 when the drive plate 2 comes near the most-advanced or most-retarded position relative to the guide plate 24, which brings about a smoothed stopping of the relative rotation between each sliding member 11 (or drive plate 2) and the guide plate 24.

In the following, operation of the valve timing control device 100 of the first embodiment will be described with reference to the drawings.

For ease of understanding, the description will be commenced with respect to a condition provided at the time when an associated engine is just started and/or under idling operation.

Under such condition, the first and second electromagnetic brakes 26 and 27 are both deenergized by an instruction signal from the controller 7. For the above-mentioned reason, the annular friction pad 37 of the second brake 27 is in frictional engagement with the brake flange 34. Accordingly, to the sun gear 30 of the planetary gear unit 25, there is applied a braking force, so that together with rotation of the drive plate 2, the guide plate 24 is rotated in a speed increasing direction, and thus the sliding members 11 are kept at their radially outermost positions. As a result, as is understood from FIG. 2, the lever shaft 13 (viz., camshaft 1), which is pivotally connected to the sliding members 11 through the link arms 14 and the radial levers 12, is kept in the most-retarded position relative to the drive plate 2.

Accordingly, under this condition, the phase of rotation of the camshaft 1 is controlled to the most-retarded side, which promotes a stable running of the engine as well as a saved fuel consumption of the engine.

When now the engine is shifted to a normal operation condition, the controller 7 energizes the first and second electromagnetic brakes 26 and 27. Upon this, the friction pad 37 of the first electromagnetic brake 26 becomes in frictional contact with the guide plate 24 and at the same time, the friction pad 37 of the second electromagnetic brake 27 is released from the brake flange 34. Thus, the sun gear 30 becomes free and the guide plate 24 is applied with a braking force, so that the guide plate 24 makes a rotation relative to the drive plate 2 in a speed reducing direction. As a result, the rolling ball 22 of each sliding member 11 is forced to move in and along the spiral guide groove 28 toward the center of the same, and thus, each sliding member 11 is moved to the radially innermost position, as shown in FIG. 3. During this movement, the link arms 14 pivotally connected to the sliding members 11 push the respective radial levers 12 forward in rotation direction, so that the lever shaft 13 (or camshaft 1) is shifted to the most-advanced angular position relative to the drive plate 2.

Accordingly, under this condition, the phase of rotation of the crankshaft and the camshaft 1 is controlled to the most-advanced side, which promotes a power generation of the engine.

When, under this condition, it is intended to control the phase of rotation of the camshaft 1 toward a retarded side relative to the crankshaft, the first and second electromagnetic brakes 26 and 27 are deenergized by the controller 7. With this, the friction pad 37 of the first brake 26 is released from the guide plate 24 and the friction pad 37 of the second electromagnetic brake 37 becomes into frictional contact with the brake flange 34. With this, the sun gear 30 of the planetary gear unit 25 is applied with a braking force, and thus, the guide plate 24 is rotated in a speed increasing direction moving the sliding members 11 toward their radially outermost positions. As a result, as is understood from FIG. 2, the link arms 14 pull the radial levers 12, causing the camshaft 1 (or lever shaft 13) to take a delayed angular position relative to the drive plate 2.

As is described hereinabove, in the valve timing control device 100 of the invention, each of the sliding members 11 moves in a radial direction on the front face of the drive plate 2 along the corresponding radial guide unit 10, and the radial displacement of each sliding member 11 is converted to a relative rotation between the drive plate 2 and the camshaft 1. Thus, the valve timing control device 100 can be constructed compact in size without sacrificing an assured phase-change operation of the same.

Furthermore, in the valve timing control device 100 of the invention, the rolling balls 22 projected from the sliding members 11 are slidably and rotatably received in the spiral guide groove 28 of the guide plate 24, so that the rotation of the guide plate 24 relative to the drive plate 2 is converted to a radial displacement of the sliding members 11 with the aid of the guiding function possessed by the spiral guide groove 28. Accordingly, without increasing the axial length thereof, the device 100 obtains a smoothed movement transmission from the guide plate 24 to the sliding members 11 and at the same time suppresses a fluctuation of the sliding members 11 which would be caused by a force inputted from the link arms 14.

Furthermore, since, in the device 100, the rolling balls 22 rotatably received in the semi-spherical recesses 21 of the sliding members 11 are slidably and rotatably received in the spiral guide groove 28 of the guide plate 24 which has a semi-circular cross section, the relative rotation between the guide plate 24 and each of the sliding members 11 is carried out smoothly due to rotation of the rolling balls 22, which reduces or at least minimizes an undesired operation resistance produced therebetween. Furthermore, since the rear side of each sliding member 11 has the roller unit 44 (viz., rollers 19) biased by the spring plate 20, the radial movement of the sliding member 11 on the drive plate 2 is smoothly carried out with a minimized resistance. Due to this minimized resistance applied to the sliding members 11, the magnetic force needed by the first and second electromagnetic brakes 26 and 27 is reduced, which brings about a possibility of usage of a compact, lower power and thus inexpensive electromagnetic brakes.

Furthermore, since each spring plate 20 biases also the sliding member 11 toward the rolling ball 22, the rolling ball 22 can be constantly centered in both the spiral guide groove 28 and the semi-spherical recess 21. Usage of the spring plates 20 as a biasing means for biasing the roller units 44 facilitates the layout of the biasing means in the device 100 and makes it possible to reduce the size of the device 100.

If desired, the guide plate 24 (or the spiral guide groove 28) may be biased toward the rolling balls 22 by suitable biasing means. Also in this case, the above-mentioned advantageous effects are also obtained.

Figure 7:
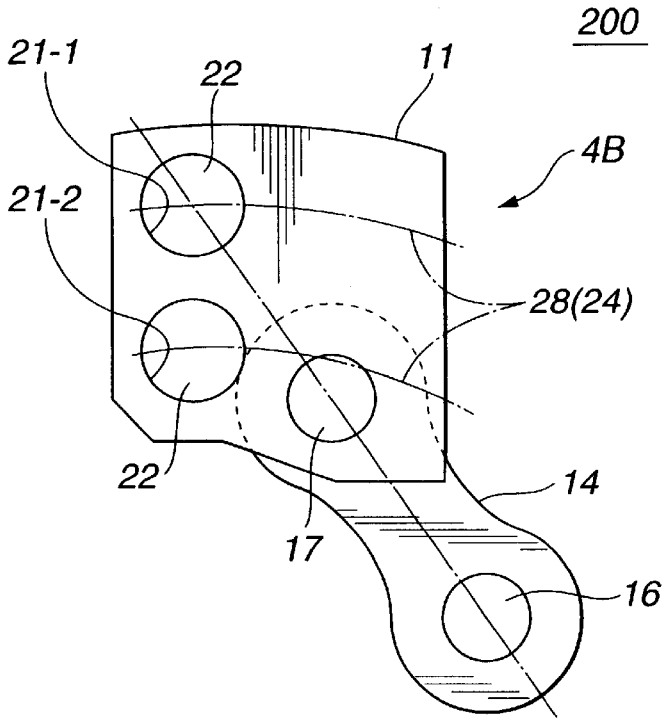
FIG. 7 is a side view of a unit including a sliding member and a link arm, which is employed in a valve timing control device of a second embodiment of the present invention.

Referring to FIG. 7, there is shown but partially a relative rotation angle control mechanism 4B employed in a valve timing control device 200 of a second embodiment of the present invention.

In this second embodiment 200, each sliding member 11 is formed on the front surface thereof with two semi-spherical recesses 21-1 and 21-2 into which two rolling balls 22 are respectively received, and these two recesses 21-1 and 21-2 are spaced in a radial direction with respect to the spiral guide groove 28 of the guide plate 24. Thus, the two rolling balls 22 are received in radially spaced portions of the spiral guide groove 28, as shown. Due to usage of the two rolling balls 22 for each sliding member 11, much smoother radial movement of the sliding member 11 is obtained. That is, due to usage of the two rolling balls 22, undesired inclination of the sliding member 11 is suppressed or at least minimized even when the line of action of the link arm 14 varies its inclination angle.

Figure 8:
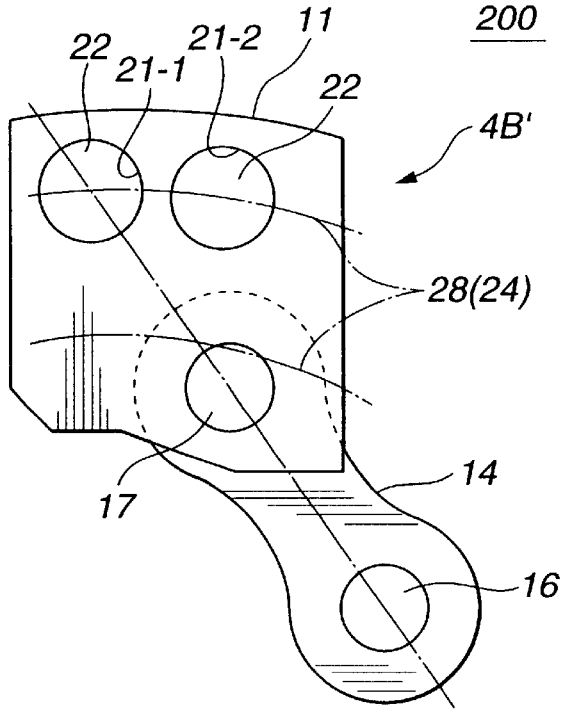
FIG. 8 is a view similar to FIG. 7, but showing a modification of the unit employed in the device of the second embodiment.

Referring to FIG. 8, there is shown a modification 4B' of the relative rotation angle control mechanism 4B of the second embodiment 200. In this modification 4B' , the two semi-spherical recesses 21-1 and 21-2 are spaced in a circumferential direction along which the spiral guide groove 28 extends. Thus, the two rolling balls 22 are received in circumferentially spaced portions of the spiral guide groove 28, as shown. Due to usage of the two rolling balls 22 for each sliding member 11, substantially same advantage as the above-mentioned one is obtained.

Figure 9:
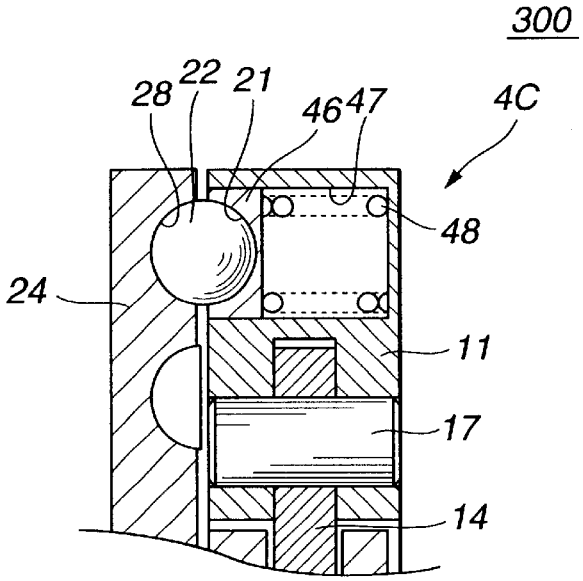
FIG. 9 is a partial sectional view of an essential portion of a valve timing control device of a third embodiment of the present invention.

Referring to FIG. 9, there is shown a partial sectional view of a relative rotation angle control mechanism 4C employed in a valve timing control device 300 of a third embodiment of the present invention.

In this embodiment 300, each sliding member 11 is equipped with a biasing means for biasing the rolling ball 22 toward the guide plate 24. That is, the biasing means comprises a cylindrical bore 47 which is formed in the front part of the sliding member 11, a circular ball holder 46 which is slidably received in the cylindrical bore 47 and formed with a semi-spherical recess 21 for rotatably receiving the rolling ball 22, and a coil spring 48 which is received in the cylindrical bore 47 to bias the circular ball holder 46 toward the guide plate 24. Due to function of the biasing means having the above-mentioned construction, the rolling ball 22 is held much softly by the sliding member 11 as compared with the first and second embodiments 100 and 200, which promotes the smoothed traveling of the rolling ball 22 along the spiral guide groove 28.

Figure 10:
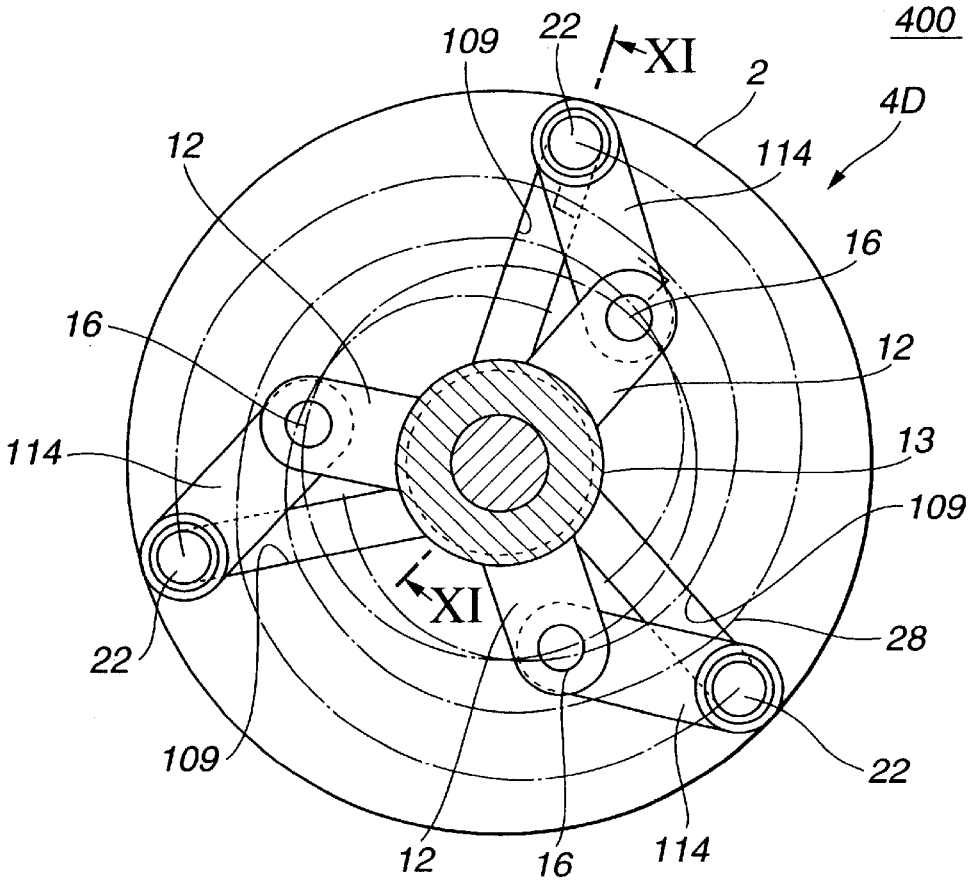
FIG. 10 is a sectional view of a valve timing control device of a fourth embodiment of the present invention, which is taken along the line "X—X" of FIG. 11.
Figure 11:
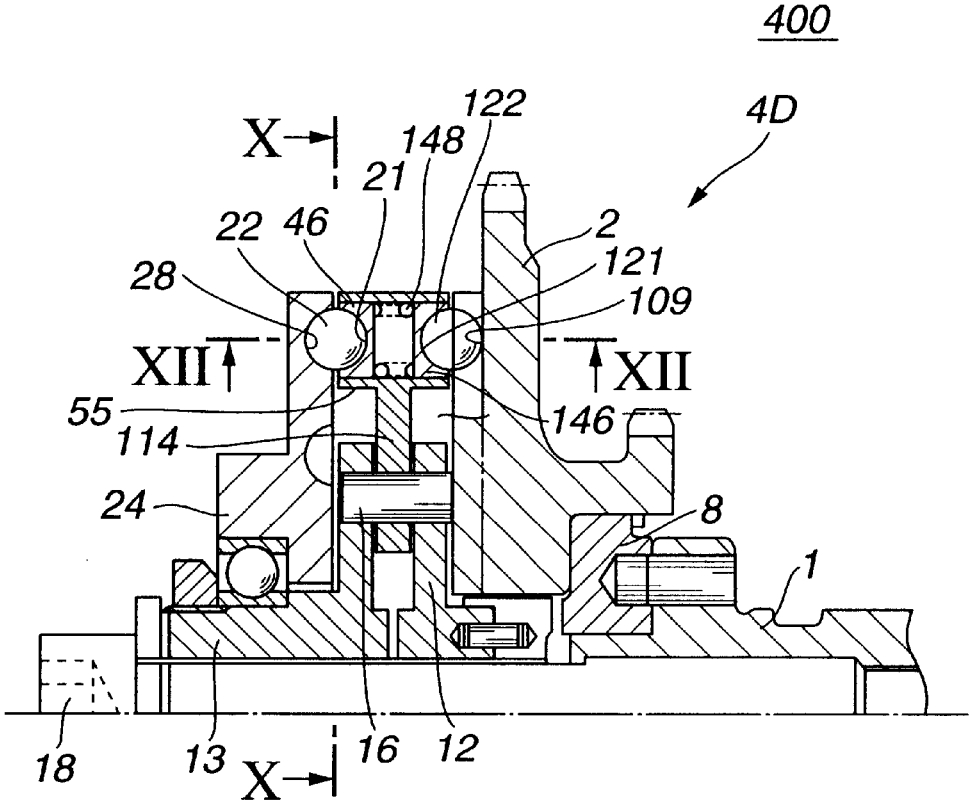
FIG. 11 is a sectional view taken along the line "XI—XI" of FIG. 10.
Figure 12:
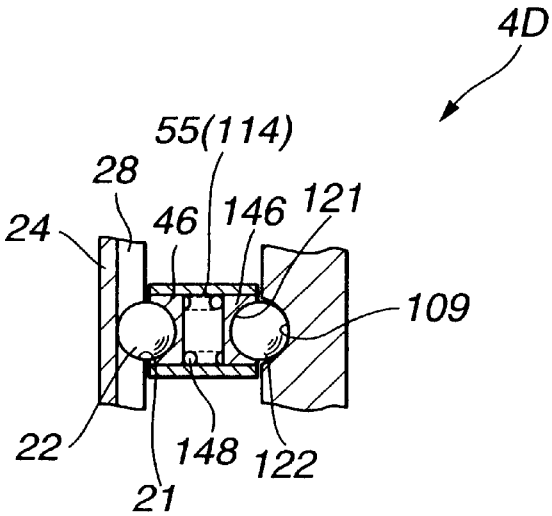
FIG. 12 is a sectional view taken along the line "XII—XII" of FIG. 11.

Referring to FIGS. 10 to 12, there is shown a relative rotation angle control mechanism 4D employed in a fourth embodiment 400 of the present invention.

For facilitation of description, substantially same parts as those of the above-mentioned first embodiment 100 are denoted by the same numerals, and detailed description of such parts will be omitted for facilitation of explanation.

As is seen from FIGS. 10 and 11, the relative rotation angle control mechanism 4D comprises a lever shaft 13 which is coaxially secured to a left end (as viewed in FIG. 11) of a camshaft 1 together with a spacer 8 by means of a bolt 18.

As is seen from FIG. 10, the lever shaft 13 is integrally formed with three radial levers 12 which are arranged at evenly spaced intervals. From the radial levers 12, there extend respective link arms 114 through pivot pins 16.

As is seen from FIG. 11, each link arm 114 has at a leading end thereof a cylindrical through bore 55 whose axis extends in parallel with the axis of the lever shaft 13. First and second circular ball holders 46 and 146 are slidably received in the through bore 55, which are formed with respective semi-spherical recesses 21 and 121 at their outside surfaces for rotatably receiving rolling balls 22 and 122. A coil spring 148 is received in the through bore 55 and compressed between the two ball holders 46 and 146 for biasing the rolling balls 22 and 122 axially outward. That is, the ball 22 is biased leftward, that is, toward a circular guide plate 24, and the other ball 122 is biased rightward, that is, toward a circular drive plate 2. The circular drive plate 2 is rotatably disposed on the annular spacer 8.

As is seen from FIGS. 10 and 11, the circular guide plate 24 is formed with a concentric spiral guide groove 28 into which the rolling ball 22 of each through bore 55 is slidably and rotatably received. The circular drive plate 2 is formed on its front surface with three radially extending guide grooves 109 which are equally spaced from one another. The other rolling balls 122 of the through bores 55 are slidably and rotatably received in the radial guide grooves 109 respectively.

It is now to be noted that the three radial guide grooves 109 are not limited to such radial grooves that extend exactly in radial directions. That is, the three radial guide grooves 109 may be arranged to extend in generally radial directions, as shown in FIG. 10.

Although not well shown in the drawings, a planetary gear unit (25) and first and second electromagnetic brakes (26) and (27) are incorporated with the guide plate 24 and the lever shaft 13 in such a manner as has been described in the part of the first embodiment 100 (see FIG. 1).

In the valve timing control device 400 of the fourth embodiment, the rolling balls 22 and 122 projected from each through bore 55 are arranged on a common axis, and the through bore 55 is held by the two ball holders 46 and 146 having the rolling balls 22 and 122 respectively engaged with the spiral guide groove 28 and the radial guide groove 109. Thus, the leading end of each link arm 114 is rotatable about the ball holders 46 and 146, so that when the guide plate 24 rotates relative to the drive plate 2, the ball holders 46 and 146 are forced to move in a radial direction while being guided by the spiral guide groove 28 and the radial guide groove 109.

In the valve timing control device 400 of this fourth embodiment, the ball holders 46 and 146 received in the leading end of each link arm 114 constitute a sliding structure which corresponds to the sliding member (11) employed in the above-mentioned first embodiment 100. Thus, as compared with the sliding member (11), the sliding structure can be made compact in size and light in weight. Since the rolling balls 122 are slidably engaged with the radial guide grooves 109 of the drive plate 2, radial movement of the sliding structure (46 and 146) is smoothly made. The two ball holders 46 and 146 are biased in opposite direction by only one coil spring 148, which promotes reduction of number of parts needed for producing the valve timing control device 400.

Figure 13:
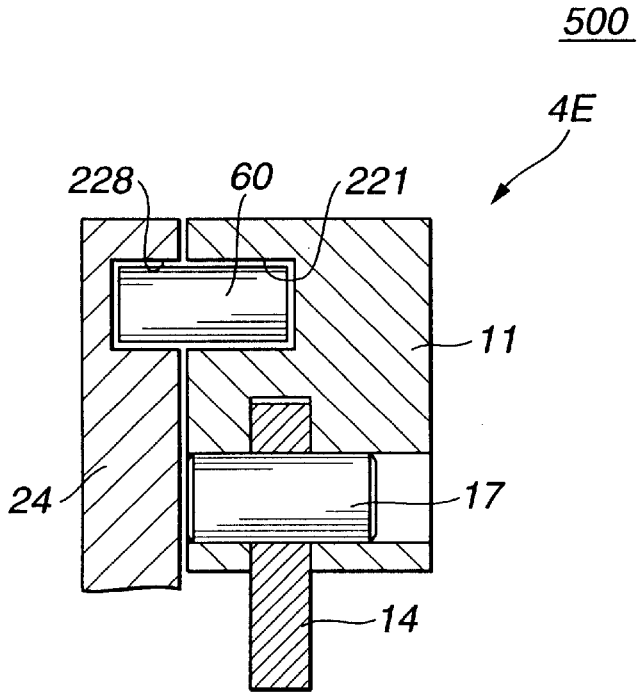
FIG. 13 is a partial sectional view of an essential portion of a valve timing control device of a fifth embodiment of the present invention.
Figure 14:
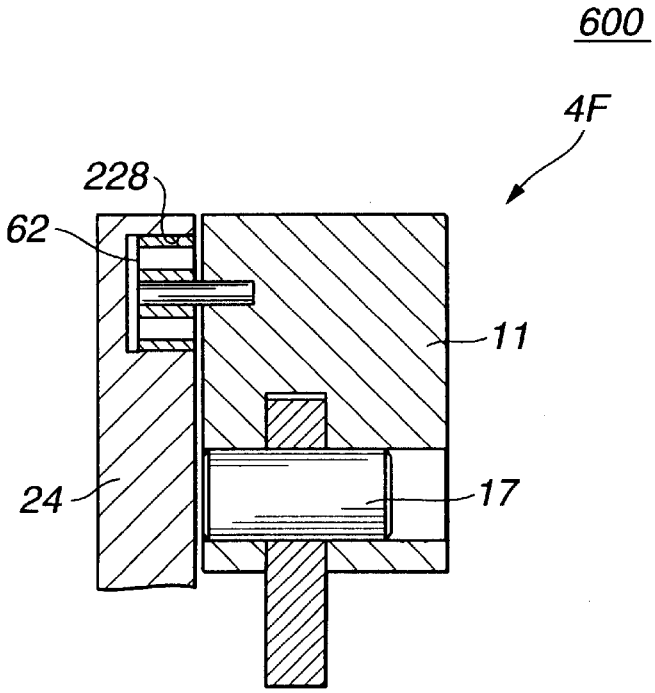
FIG. 14 is a view similar to FIG. 13, but showing a sixth embodiment of the present invention.
Figure 15:
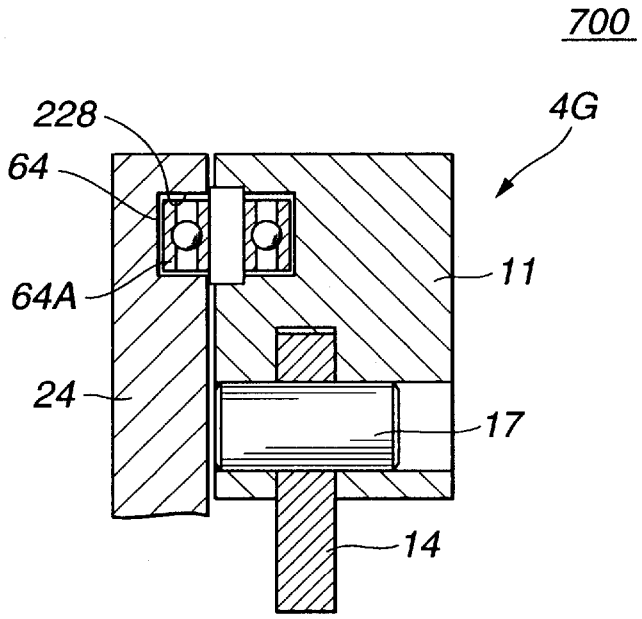
FIG. 15 is a view similar to FIG. 13, but showing a seventh embodiment of the present invention.

Referring to FIGS. 13, 14 and 15, there are shown views similar to FIG. 9, but showing relative rotation angle control mechanisms 4E, 4F and 4G employed in fifth, sixth and seventh embodiments 500, 600 and 700 of the present invention, respectively.

In the relative rotation angle control mechanism 4E of the fifth embodiment 500, each sliding member 11 is formed with a cylindrical bore 221 in which a cylinder member 60 is rotatably received with its front part projected therefrom. The projected front part of the cylinder member 60 is slidably received in a spiral guide groove 228 formed in a guide plate 24. As shown, the guide groove 228 is shaped to have a rectangular cross section. In the relative rotation angle control mechanism 4F of the sixth embodiment 600, each sliding member 11 is provided with a needle bearing 62 which is rotatably engaged with side walls of a spiral guide groove 228 formed in a guide plate 24. In the relative rotation angle control mechanism 4G of the seventh embodiment 700, each sliding member 11 is equipped with a ball bearing 64 which comprises a center shaft, an inner race disposed on the center shaft, an outer race 64A and a plurality of balls put between the inner and outer races. As shown, the center shaft is held by the sliding member 11 having the outer race 64A run on a bottom wall of a spiral guide groove 228 formed in the guide plate 24. Due to usage of the rotating member 60, 62 or 64, the operating resistance of the relative rotation angle control mechanism 4E, 4F or 4G is reduced, which promotes the smoothed movement of the valve timing control device 500, 600 or 700 of the fifth, sixth and seventh embodiments of the present invention.

If desired, in place of the above-mentioned rotating member 60, 62 or 64, a rod may be used. That is, in this case, the rod is secured to the sliding member 11, and a head portion of the rod is slidably engaged with a spiral guide groove formed in the guide plate 24.

Figure 16:
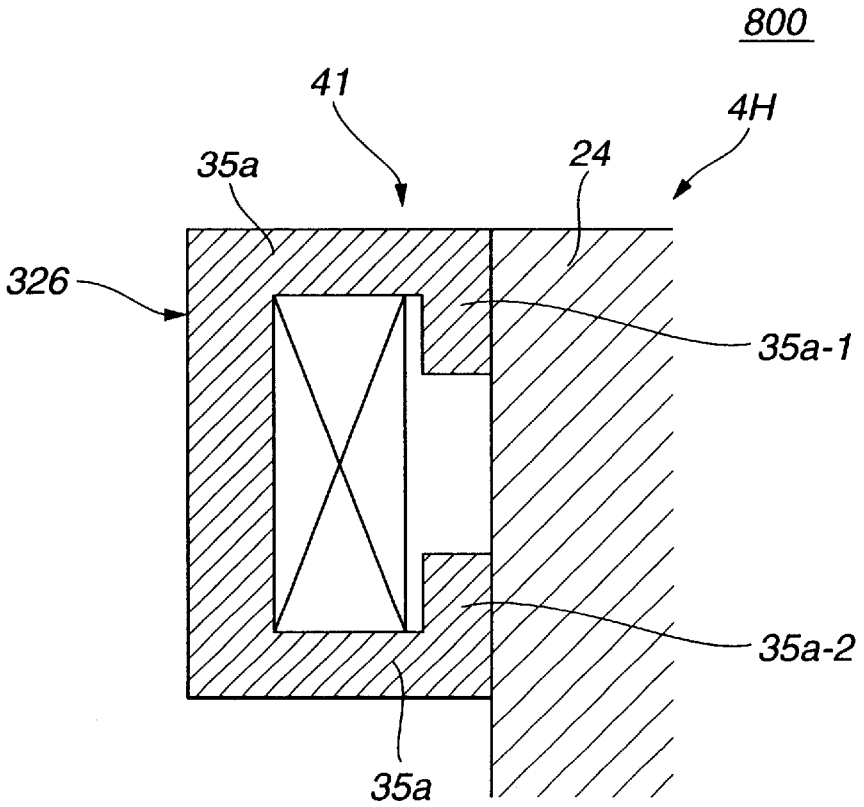
FIG. 16 is a schematic sectional view of a portion of a valve timing control device of an eighth embodiment of the present invention.

Referring to FIG. 16, there is shown a part of a relative rotation angle control mechanism 4H employed in an eighth embodiment 800 of the present invention.

This embodiment 800 is substantially the same as the first embodiment 100 of FIG. 1 except for a guide plate actuating mechanism 41. That is, in the eighth embodiment 800, the first electromagnetic brake 326 of the guide plate actuating mechanism 41 has no friction pad. As is seen from the drawing, a yoke 35*a* of the electromagnetic brake 326, which generates a magnetic force, is kept in contact with a flat front surface of a circular guide plate 24. As shown, the yoke 35*a* is constructed to have a generally C-shaped cross section to increase the area where the generated magnetic flux goes out and comes back. That is, one end 35*a*-1 of the yoke 35*a* from which the magnetic flux goes out and the other end 35*a*-2 of the yoke 35*a* to which the magnetic flux comes back are positioned close to each other. If desired, a lubricant oil may be applied to mutually contacting surfaces of the yoke 35*a* and guide plate 24.

As is seen from the above, in this eighth embodiment 800, stopping of the guide plate 24 is achieved by only an attractive force generated by the yoke 35*a* when the coil is energized. That is, the stopping of the guide plate 24 is carried out without the aid of a friction force used in the first embodiment 100. Since, in this eighth embodiment 800, no air gap is defined between the mutually contacting surfaces of the yoke 35*a* and guide plate 24, passing of the magnetic flux through the mutually contacting surfaces is effectively carried out, which promotes generation of the magnetic flux and thus obtains a sufficient braking force. In addition to this, friction heat is minimized due to non-use of the friction pad. In addition to the substantially same advantages as those of the above-mentioned first embodiment 100, this eighth embodiment 800 has such an advantage that, due to non-use of the friction pad, compactness of the guide plate actuating mechanism 41 and thus that of the entire construction of the valve timing control device is promoted.

The entire contents of Japanese Patent Application 2001-24077 filed Jan. 31, 2001 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A valve timing control device of an internal combustion engine, comprising:

a drive rotation member rotated about a given axis by a crankshaft of the engine;

a driven rotation member rotated about said given axis together with a camshaft of the engine;

a relative rotation angle control mechanism through which said drive and driven rotation members are coaxially connected, said relative rotation angle control mechanism having a movable control member which, when actuated, varies a relative rotation angle between said drive and driven rotation members in accordance with an operation condition of the engine, said relative rotation angle control mechanism comprising:

a radial guide provided by one of said drive and driven rotation members;

said movable control member guided by said radial guide in a manner to move in a radial direction with respect to said given axis;

a link which links said movable control member to a given portion of the other of said drive and driven members, said given portion being positioned away from said given axis in a radial direction;

an intermediate rotation member rotatable about said given axis relative to both said drive and driven rotation members;

a spiral guide provided by said intermediate rotation member to guide the movement of said movable control member, so that rotation of said intermediate rotation member relative to said radial guide induces a radial movement of said movable control member; and a sliding resistance reducing structure arranged between said movable control member and said intermediate rotation member to reduce a sliding resistance produced when said movable control member is moved.

2. A valve timing control device as claimed in claim 1, in which said sliding resistance reducing structure comprises a roller mechanism which is constructed to roll along a direction in which said movable control member and said intermediate rotation member make a relative movement therebetween.

3. A valve timing control device as claimed in claim 2, in which said roller mechanism comprises a roller member held by said movable control member, said roller member being slidably engaged with said spiral guide.

4. A valve timing control device as claimed in claim 3, in which said spiral guide comprises a spiral guide groove which is formed in said intermediate rotation member on a surface facing said movable control member.

5. A valve timing control device as claimed in claim 4, in which said movable control member is provided with a ball holding structure, and in which said roller member comprises a rolling ball which is slidably and rotatably engaged with both said spiral guide groove and ball holding structure.

6. A valve timing control device as claimed in claim 5, in which said ball holding structure is a semi-spherical recess formed in said movable control member on a surface facing said intermediate rotation member, and in which said spiral guide groove has a semi-circular cross section.

7. A valve timing control device as claimed in claim 6, in which each end portion of said spiral guide groove has a gradually reducing depth, so that as the rolling ball comes near the end portion, movement of said rolling ball is gradually braked by said intermediate control member and said movable control member.

8. A valve timing control device as claimed in claim 6, in which placing of said rolling ball relative to said movable control member is so made that a center of said rolling ball is placed in a range between a line of action of said link appearing when said driven rotation member assumes the most-retarded angular position relative to said drive rotation member and another line of action of said link appearing when said driven rotation member assumes the most-advanced rotation angle relative to said drive rotation member.

9. A valve timing control device as claimed in claim 6, in which at least one of said spiral guide groove and said semi-spherical recess has a radius of curvature that is greater than that of said rolling ball.

10. A valve timing control device as claimed in claim 6, further comprising:

another semi-spherical recess formed on the surface of said movable control member; and another rolling ball rotatably received in said another semi-spherical recess and rotatably and slidably engaged with said spiral guide groove.

11. A valve timing control device as claimed in claim 6, further comprising a biasing structure which biases at least one of said intermediate rotation member and said movable control member toward said rolling ball.

12. A valve timing control device as claimed in claim 11, in which said biasing structure comprises a plate spring which is arranged in a part of said movable control member to bias said movable control member toward said rolling ball.

13. A valve timing control device as claimed in claim 12, further comprising a roller unit which is provided by said movable control member to smooth the radial movement of said movable control member on and along a guide way defined by said radial guide, and in which said roller unit is biased toward said guide way by said plate spring.

14. A valve timing control device as claimed in claim 5, in which said ball holding structure comprises:

an axial bore formed in said movable control member;

a ball holder axially movably received in said axial bore and formed at a front end thereof with a semi-spherical recess for rotatably receiving said rolling ball; and a biasing member received in said bore to bias said ball holder and thus the rolling ball toward said spiral guide groove.

15. A valve timing control device as claimed in claim 4, in which said radial guide is a radially extending guide groove formed in said one of the drive and driven rotation members, in which said movable control member is a first rolling ball travelling along said radially extending guide groove, and in which said roller mechanism comprises:

a second rolling ball slidably engaged with said spiral guide groove, a through bore formed in said link;

two ball holders axially movably received in said through bore and rotatably holding said first and second rolling balls on their outside ends; and a spring member compressed between said two ball holders to press said first and second rolling balls against said radially extending guide groove and said spiral guide groove respectively.

16. A valve timing control device as claimed in claim 15, in which said two ball holders are respectively formed at their outside ends with semi-spherical recesses for rotatably receiving therein said first and second rolling balls.

17. A valve timing control device as claimed in claim 4, in which said roller member is a cylinder member, said cylinder member having one end rotatably received in a cylindrical bore formed in said movable control member and the other end slidably engaged with said spiral guide groove.

18. A valve timing control device as claimed in claim 4, in which said roller member is a needle bearing held by said movable control member, said needle bearing being rotatably engaged with opposed side walls of said spiral guide groove.

19. A valve timing control device as claimed in claim 1, further comprising a speed change mechanism which allows said intermediate rotation member to take a desired angular position relative to said radial guide with the aid of electromagnetic force.

20. A valve timing control device as claimed in claim 19, in which said speed change mechanism comprises:

a planetary gear unit arranged between said intermediate rotation member and said driven rotation member; and first and second electromagnetic brakes which are arranged to apply a braking force to given rotatable parts of said planetary gear unit to brake the same.

21. A valve timing control device as claimed in claim 20, in which a yoke of said first electromagnetic brake is arranged to directly and slidably contact said intermediate rotation member.

22. A valve timing control device as claimed in claim 21, in which a lubricant oil is applied to mutually contacting surfaces of said yoke and said intermediate rotation member.

23. A valve timing control device of an internal combustion engine, comprising:

a drive rotation member rotated about a given axis by a crankshaft of the engine;

a driven rotation member rotated about said given axis together with a camshaft of the engine;

a radial guide provided by one of said drive and driven members;

a movable control member guided by said radial guide in a manner to move in a radial direction with respect to said given axis;

a link linking said movable control member to a given portion of the other of said drive and driven members, said given portion being positioned away from said given axis in a radial direction;

an intermediate rotation member rotatable about said given axis relative to both said drive and driven rotation members;

a spiral guide groove provided on one surface of said intermediate rotation member;

a semi-spherical recess formed in said movable control member, said recess facing said one surface of said intermediate rotation member; and a rolling ball rotatably and slidably engaged with both said spiral guide groove and said semi-spherical recess.

24. A valve timing control device of an internal combustion engine, comprising:

a drive rotation member rotated about a given axis by a crankshaft of the engine;

a driven rotation member rotated about said given axis together with a camshaft of the engine;

a radial guide provided by one of said drive and driven members;

a movable control member guided by said radial guide in a manner to move in a radial direction with respect to said given axis;

a link linking said movable control member to a given portion of the other of said drive and driven members, said given portion being positioned away from said given axis in a radial direction;

an intermediate rotation member rotatable about said given axis relative to both said drive and driven rotation members;

a spiral guide groove provided on one surface of said intermediate rotation member, said spiral guide groove having a semi-circular cross section;

a semi-spherical recess formed in said movable control member, said recess facing said one surface of said intermediate rotation member; and a rolling ball rotatably and slidably engaged with both said spiral guide groove and said semi-spherical recess, at least one of said spiral guide groove and said semi-spherical recess having a radius of curvature that is greater than that of said rolling ball.

25. A valve timing control device of an internal combustion engine, comprising:

a drive rotation member rotated about a given axis by a crankshaft of the engine;

a driven rotation member rotated about said given axis together with a camshaft of the engine;

a radial guide provided by one of said drive and driven members;

a movable control member guided by said radial guide in a manner to move in a radial direction with respect to said given axis;

a link linking said movable control member to a given portion of the other of said drive and driven members, said given portion being positioned away from said given axis in a radial direction;

an intermediate rotation member rotatable about said given axis relative to both said drive and driven rotation members;

a spiral guide groove provided on one surface of said intermediate rotation member;

a semi-spherical recess formed in said movable control member, said recess facing said one surface of said intermediate rotation member;

a rolling ball rotatably and slidably engaged with both said spiral guide groove and said semi-spherical recess; and a biasing structure which biases at least one of said intermediate rotation member and said movable control member toward said rolling ball.

* * * * *